US007273389B2

(12) United States Patent
Hoppach et al.

(10) Patent No.: US 7,273,389 B2
(45) Date of Patent: Sep. 25, 2007

(54) CONNECTING ARRANGEMENT AND PRODUCTION METHOD FOR A CONNECTING ARRANGEMENT

(75) Inventors: Michael Hoppach, Spangenberg (DE); Manfred Schaarschmidt, Lautertal (DE); Lars Schlueter, Neustadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/545,010

(22) PCT Filed: Jan. 29, 2004

(86) PCT No.: PCT/EP2004/000814

§ 371 (c)(1),
(2), (4) Date: Apr. 11, 2006

(87) PCT Pub. No.: WO2004/070888

PCT Pub. Date: Aug. 19, 2004

(65) Prior Publication Data

US 2006/0223361 A1 Oct. 5, 2006

(30) Foreign Application Priority Data

Feb. 10, 2003 (DE) ..... 103 05 381

(51) Int. Cl.
*H01R 4/24* (2006.01)
*H01R 4/26* (2006.01)
*H01R 11/20* (2006.01)

(52) U.S. Cl. ..... 439/425; 439/275

(58) Field of Classification Search ..... 439/425, 439/411–413, 417, 418, 391, 400, 271, 274, 439/275

See application file for complete search history.

(56) References Cited

U.S. PATENT DOCUMENTS 2,694,183 A * 11/1954 Edlen et al. ..... 439/394
3,789,347 A * 1/1974 Cooper, Jr. ..... 439/425

FOREIGN PATENT DOCUMENTS

| | | |
|---|---|---|
| DE | 196 18 998 C1 | 1/1993 |
| EP | 1 290 236 A1 | 1/2003 |
| WO | WO 01/22534 A1 | 3/2001 |

* cited by examiner

*Primary Examiner*—Felix O. Figueroa
(74) *Attorney, Agent, or Firm*—Barley Snyder LLC

(57) ABSTRACT

A connecting arrangement includes at least first and second housings in which at least one conductor of a first cable can be electrically connected to at least one conductor of a second cable fed via a cable receiver. At least one piercing element is electrically connected to the second cable and configured to be inserted transversely into the conductor of the first cable. The cable receiver is constructed as an integral unit with the second housing and the piercing element. A sealing element configured to seal a piercing point of the piercing element is arranged on an inner side of the second housing and the cable receiver is disposed on an outer side of the second housing. The sealing element and the cable receiver are formed in one piece through the second housing.

13 Claims, 6 Drawing Sheets

CONNECTING ARRANGEMENT AND PRODUCTION METHOD FOR A CONNECTING ARRANGEMENT

BACKGROUND OF THE INVENTION

1. Field of the Invention

The invention relates to a connecting arrangement for connecting two cables and to a production method for a connecting arrangement.

2. Summary of the Prior Art

A generic connecting arrangement is known from DE 697 12 414 T2. A first cable is inserted into a housing bottom part. An end piece of a second cable is inserted into a housing upper part and locked by a screw-terminal. The insulated conductors of the second cable are isolated and inserted in mouldings of the housing upper part. A printed circuit board provided with piercing elements is then arranged on the housing upper part such that the piercing elements are each inserted into the isolated conductors of the second cable. By shutting the housing parts the piercing elements are also inserted into the first cable.

Assembly of the device is very complex and there is a certain susceptibility to failure in practice.

The object of the invention is to improve a connecting arrangement of the type mentioned at the outset such that the connecting arrangement is, in an optimally simple manner, less susceptible to failure, easier to handle and assemble.

EP 1 280 236 A1 discloses a coupling element comprising an upper housing member as well as a lower housing member. The upper housing member comprises an upper portion having the function of a cable receiver and partially encasing a cable, connection parts and a plate-like carrier of the upper housing member. The plate-like carrier is made from a mechanically strong isolating material, e.g., glass fiber-reinforced polyester, wherein the connection parts are fixed within the plate-like carrier. A feeder inserted into the lower housing member is electrically connected with the cable by the connection parts piercing through the insulation material of the feeder. An O-ring like sealing member can be provided in an interior of the coupling element to abut against the feeder. The sealing member may be provided in one piece with the plate-like carrier.

IN WO 01/22534 A1, connecting arrangement having an upper housing member and a lower housing member is known. A cable inserted into the lower housing member and pierced by a contact screw is sealed with respect to the upper housing member by a sealing element being separately provided with respect to said upper housing member.

In DE 196 18 998 C1, a contact device is known having an upper housing member and a lower housing member. A cable inserted into the lower housing member is pierced by a piercing element. Around the piercing area, between the cable and the upper housing member, sealing elements inserted into recesses of the upper housing member are provided.

SUMMARY OF THE INVENTION

To acheive the forgoing and other objectives, the invention provides a connecting arrangement comprising at least first and second housings, in which at least one conductor of a first cable can be electrically connected to at least one conductor of a second cable fed via a cable receiver. At least one piercing element is electrically connected to the second cable and configured to be inserted transversely into the conductor of the first cable. To improve the connecting arrangement to the extent that, in an optimally simple manner, it is less susceptible to failure, is easier to handle, and is easier to assemble, the cable receiver is constructed as an integral unit with the second housing and the piercing element. The invention also relates to a method with which a connecting arrangement can be produced.

BRIEF DESCRIPTION OF THE DRAWINGS

An embodiment of the invention is shown in the drawings and will be described hereinafter. In the drawings.

DETAILED DESCRIPTION OF THE DRAWINGS

Figure 1:
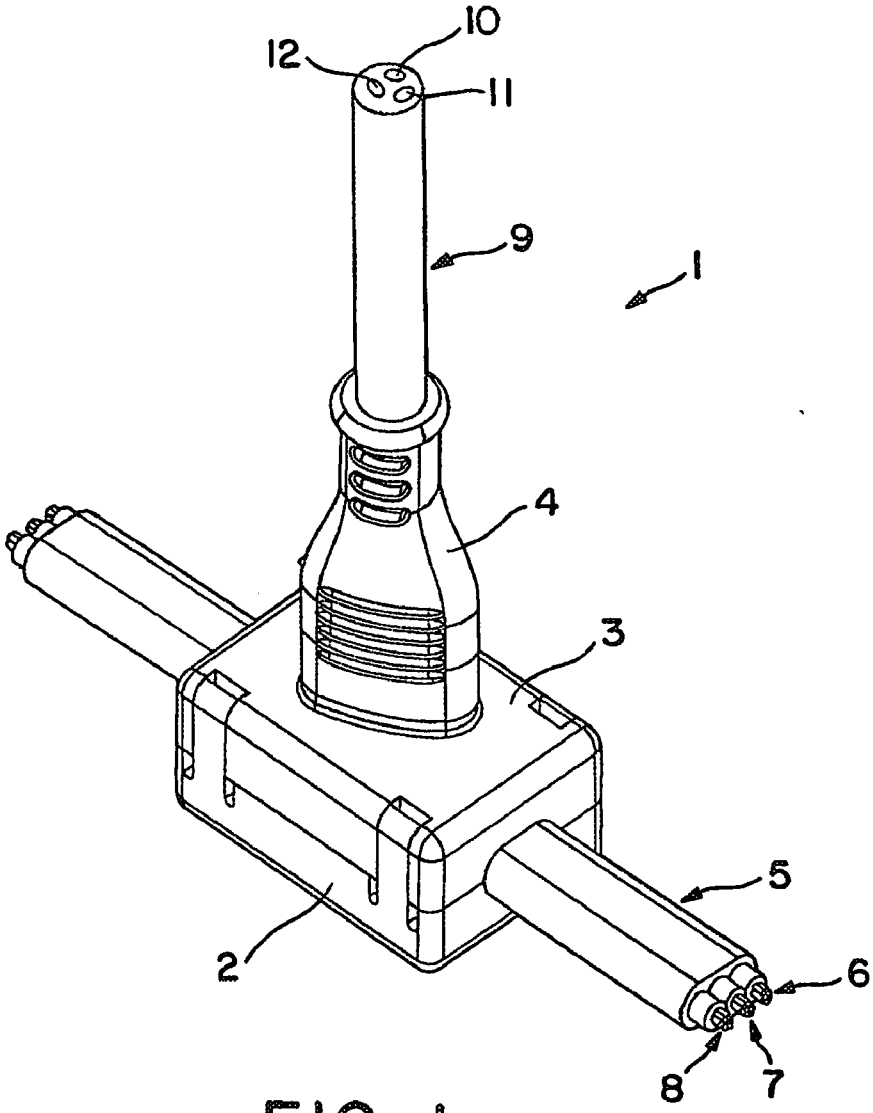
FIG. 1 shows a perspective view of the connecting arrangement according to the invention with incorporated first and second cables.

FIG. 1 shows a connecting arrangement 1 according to the invention with a first housing 2, a second housing 3 and a cable receiver 4. A first cable 5 is received longitudinally in the first housing 2, between the first and second housings 2, 3. The first cable 5 comprises conductors 6, 7, 8. The cable receiver 4 receives a second cable 9 with conductors 10, 11, 12.

Figure 2:
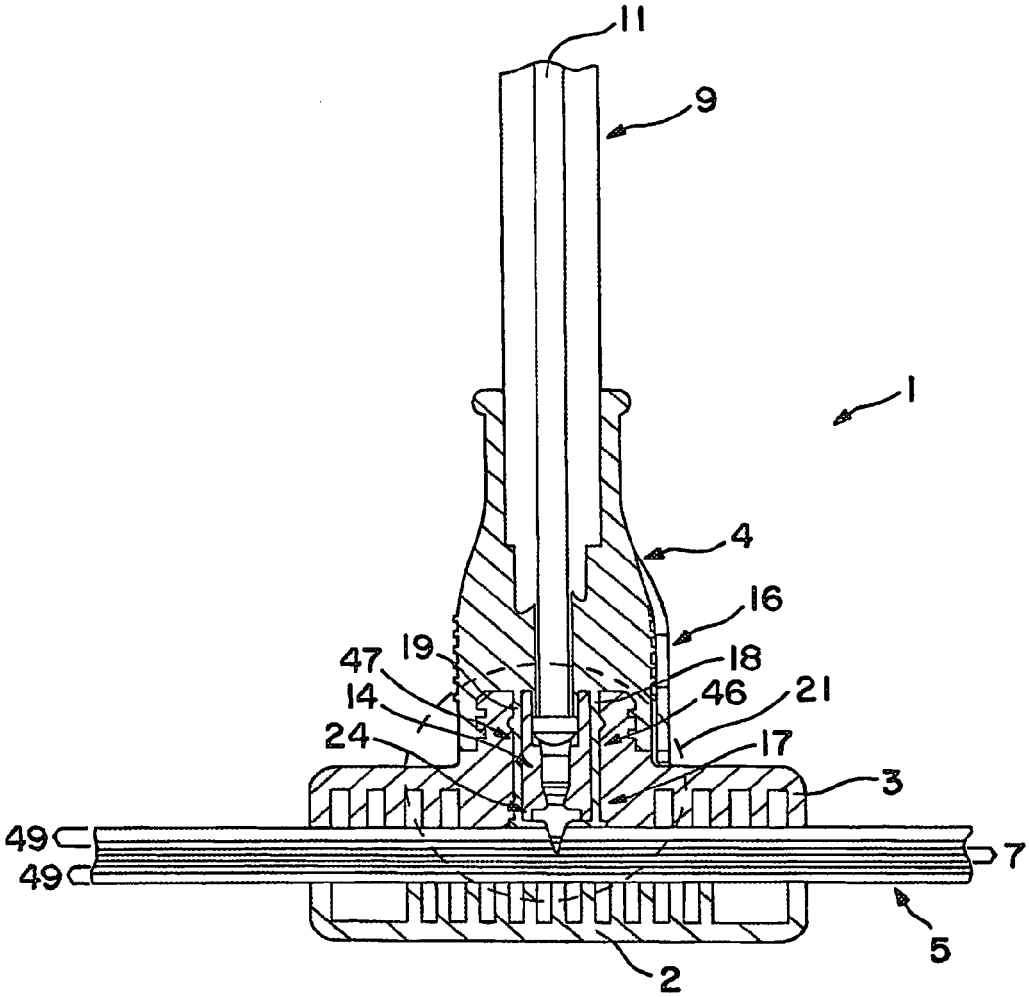
FIG. 2 shows a sectional view of the connecting arrangement of FIG. 1.

FIG. 2 shows a section through the connecting arrangement 1 shown in FIG. 1. The cable receiver 4, piercing elements 13, 14, 15 and the second housing 3 are constructed as an integral unit 16. The piercing elements 13, 14, 15 are each electrically connected to the conductors 10, 11, 12, respectively, of the second cable 9 by crimping. The conductor 12 and the piercing element 14 are shown by way of example in FIG. 2. The piercing elements 13, 14, 15 and the second cable 9 are partially embedded in an integral unit 16. The integral unit 16 of the second housing 3 and the cable receiver 4 is formed on the second cable 9 and the piercing elements 13, 14, 15 in an interlocking and sealing manner by molding.

A sealing element 17, with which piercing points 23, 24, 25 of the piercing elements 13, 14, 15 can be sealed, is arranged on an inner side 28 (shown in FIG. 4) of the second housing 3 of the integral unit 16. The sealing element 17 is constructed in one piece with the cable receiver 4 and is therefore a component of the integral unit 16. The sealing element 17 comprises connecting portions 18, 19 extending through connecting cavities 46, 47 of the second housing 3, and integrally connecting the sealing element 17 on the inner side 28 of the second housing 3 and the cable receiver 4 on an outer side 36 of the second housing 3. The sealing element 17 is designed to be undercut with respect to the cable receiver 4 and is partially arranged in a sealing recess 48 of the second housing 3.

In another embodiment of the invention the sealing element 17 can be arranged separately from the cable receiver 4 on the second housing 3 or can be formed thereon. The sealing element 17 can be component of the integral unit 16 in this case.

The sealing element 17 comprises a sealing lip 37 (FIG. 5) oriented toward the inner side 28 of the second housing 3 of the integral unit 16. The sealing lip is designed in one piece with the sealing element 17.

The cable receiver 4 is formed on the second housing 3 with an interlocking fit. The cable receiver 4 is constructed so as to correspond to a toothed profile portion 20 of the second housing 3. This can be seen particularly clearly in the enlarged detail 21 of FIG. 2 shown in FIG. 3. Relatively large forces can be transmitted between the cable receiver 4 and the second housing 3, in particular in the longitudinal direction of the second cable 9, as a result of the interlocking tooth configuration between the second housing 3 and the cable receiver 4.

Figure 3:
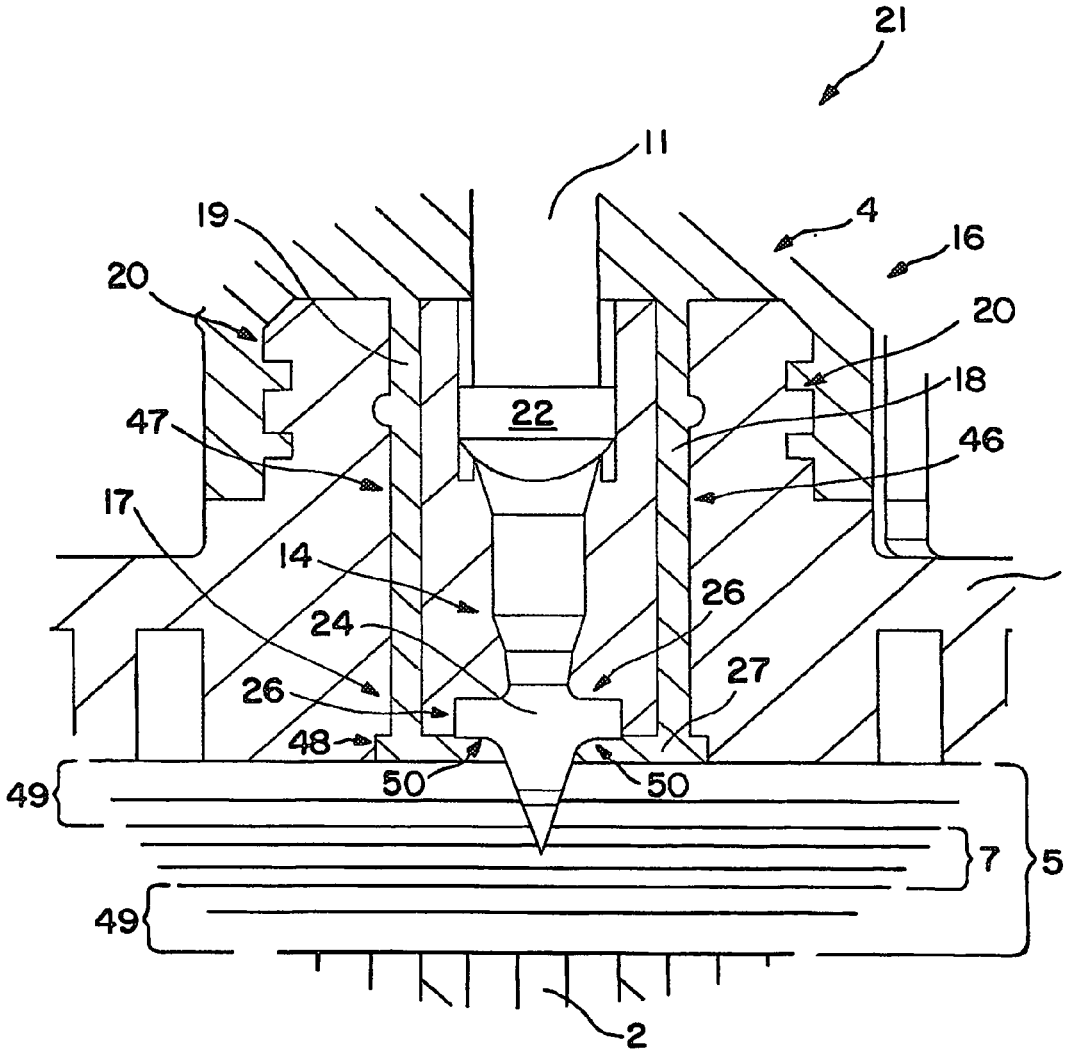
FIG. 3 shows an enlarged view of a detail from FIG. 2.

The piercing element 14 is also shown enlarged in the detail 21 shown in FIG. 3. This has a fastening portion 22 with which it is attached to the conductor 11 by crimping. Toward the inner side 28 of the second housing 3 of the integral unit 16 the piercing element 14 has a piercing point 24 tapering in the direction of the inner side 28. The piercing point 24 of the piercing element 14 is inserted into the conductor 7 of the first cable 5 by application of force.

The piercing element 14 comprises support shoulders 26 in the region of the piercing point 24. The support shoulders 26 are designed substantially transversely to the longitudinal direction of the piercing element 14 and each have a bearing face 50. The piercing element 14 is connected to an abutment portion 27 of the sealing element 17 by the bearing faces 50. In the illustrated assembled state of the connecting arrangement 1 the sealing element 17 is pressed against the surface of the first cable 5 by the support shoulders 26 in the region of the abutment portion 27. The sealing element 17 is therefore pressed against the first cable 5, particularly in the region of the piercing point 24.

The support shoulders 26 can optionally be designed as continuous disc-shaped support collars transverse to the longitudinal direction of the piercing element 14.

The piercing element 14 is inserted transversely into the conductor 7 of the first cable 5 and is consequently electrically connected thereto.

Similarly, the piercing elements 13 and 15 may also be inserted into corresponding conductors 6, 8 of the first cable 5.

The first and second housings 2, 3 are produced from thermoplastic polymer. This provides the first and second housings 2, 3 with a rigidly sufficient for secure retention of the first cable 5, for reliable connection of the first and second housings 2, 3 to one another and for reliable transmission of forces between the cable receiver 4 and the second housing 3.

The sealing element 17 and the cable receiver 4 consist of thermoplastic elastomer. This gives both components sufficient flexibility. The cable receiver 4 can therefore be easily reshaped within a certain range in order to be able to compensate for changes in the relative position of the second housing 3 and the second cable 9. The sealing element 17 has sufficient flexibility to adapt well to the bearing faces 50.

Figure 4:
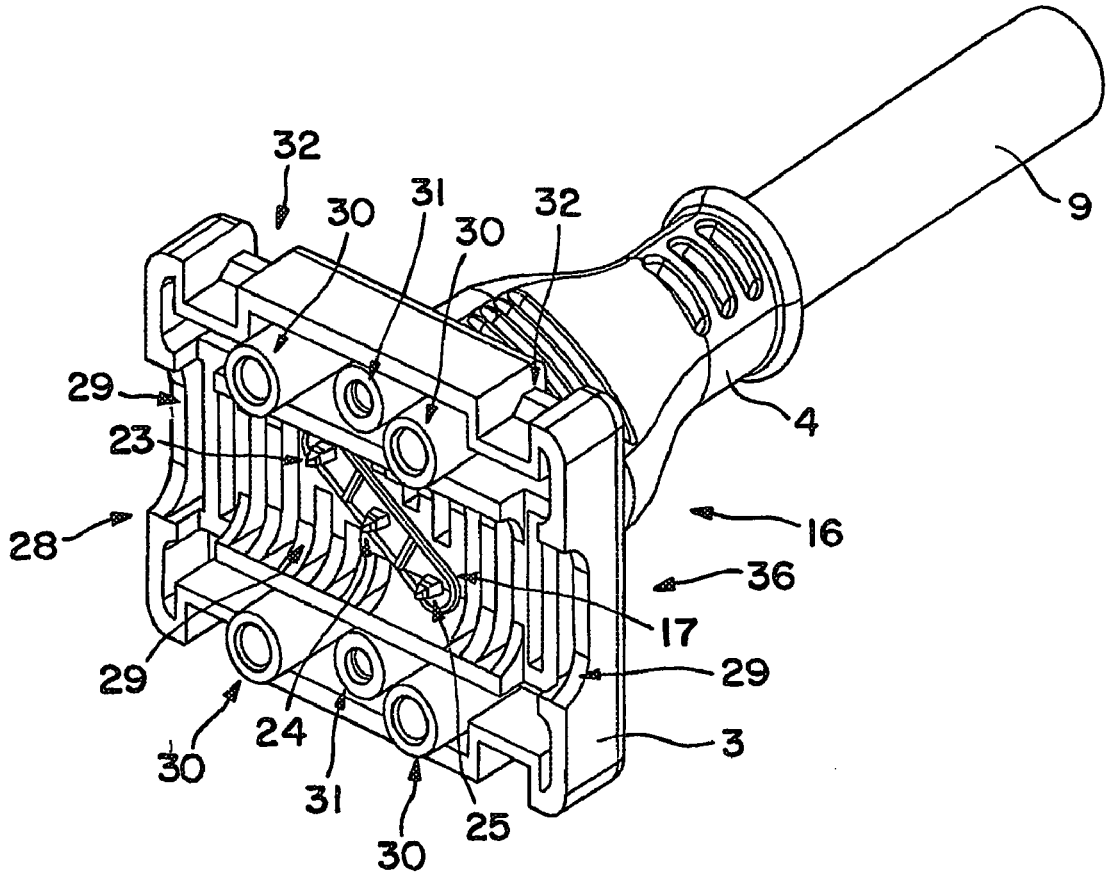
FIG. 4 shows a perspective view of an integral unit of the connecting arrangement with incorporated second cable.

FIG. 4 shows the integral unit 16 with the piercing elements 13, 14, 15 and the second cable 9 partially embedded in a perspective view. The inner side 28 of the second housing 3 of the integral unit 16 in particular is shown in more detail.

The second housing 3 has a large number of ribbings 29 adapted to the outer contour of the first cable 15. The second housing 3 is reinforced by the ribbings 29. A plurality of guide holes 30 and screw recesses 31 as well as tab grooves 32 are also provided.

The piercing points 23, 24, 25 of the piercing elements 13, 14, 15 project beyond the inner side 28 of the second housing 3. The piercing points 23, 24, 25 are each substantially annularly surrounded by the sealing element 17.

In another embodiment of the invention the piercing points 23, 24, 25 can also be peripherally surrounded in a different manner, for example angularly, elliptically or irregularly.

Figure 5:
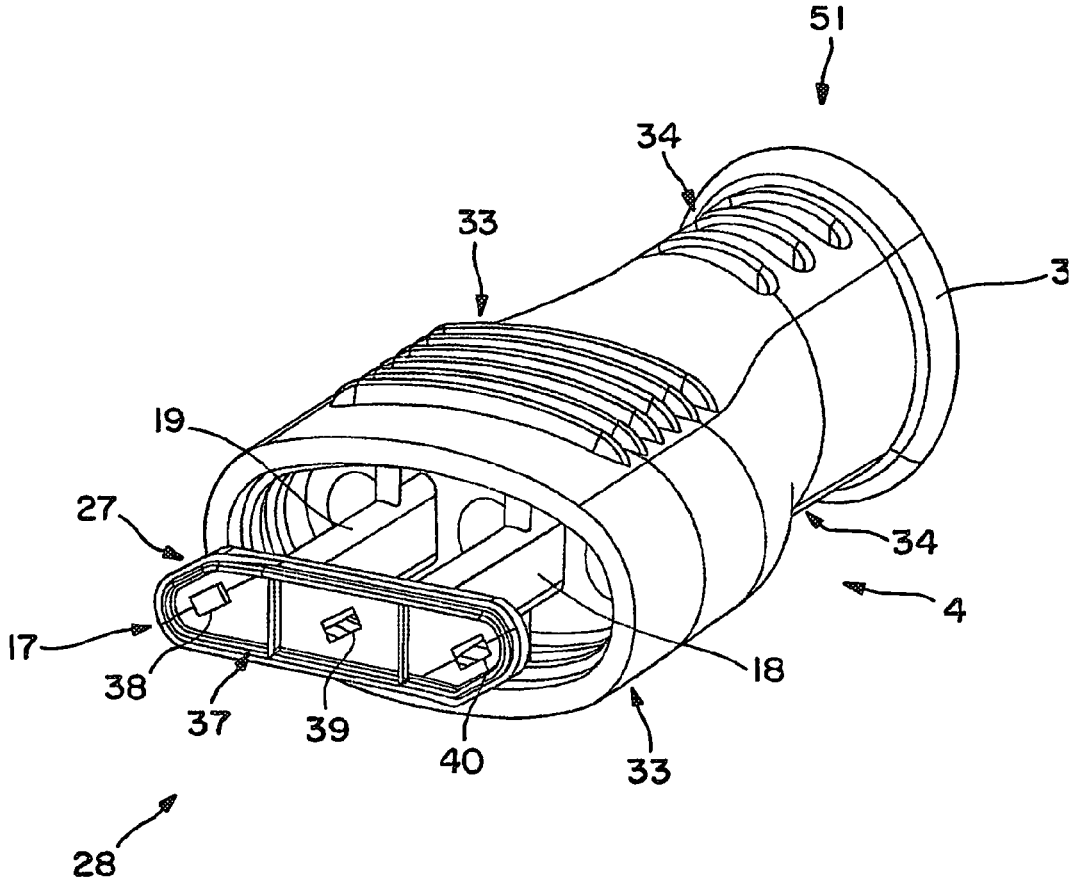
FIG. 5 shows a perspective view of a cable receiver.

FIG. 5 shows a detail perspective view of the cable receiver 4 together with its sealing element 17. On its outer surface the cable receiver 4 comprises, on either side, a gripping profile 33 and stress-reducing moldings 34. The gripping profile 33 facilitates gripping and handling of the cable receiver 4 and therefore of the integral unit 16 by a user, particularly with regard to the application of forces in the longitudinal direction of the second cable 9. The stress-reducing moldings 34 are used to reduce and compensate tensile and compressive stresses resulting during bending stress of the cable receiver 4.

A terminal bead 35 is disposed at an end 51 of the cable receiver 4, remote from the second housing 3. The terminal bead 35 is substantially annular in shape and is used to reinforce the cable receiver 4, in particular with respect to forces introduced into the cable receiver 4 by the second cable 9, and vice-versa.

The sealing element 17 comprise the sealing lip 37. The sealing lip 37 is oriented toward the inner side 28 of the housing of the integrated unit 16. It surrounds respective, substantially annular openings 38, 39, 40 of the sealing element 17 resulting from the forming of the cable receiver 4 (and therefore of the sealing element 17) to the piercing elements 13, 14, 15. The sealing lip 37 is also provided all the way around and conforming to the outer contour of the bearing portion 27.

In another embodiment of the invention the sealing lip 37 can also be constructed so as to be peripheral only corresponding to the outer contour of the bearing portion 27. In this case, the sealing lip 37 jointly seals the piercing points 23, 24, 25 produced by the piercing elements 13, 14, 15.

Figure 6:
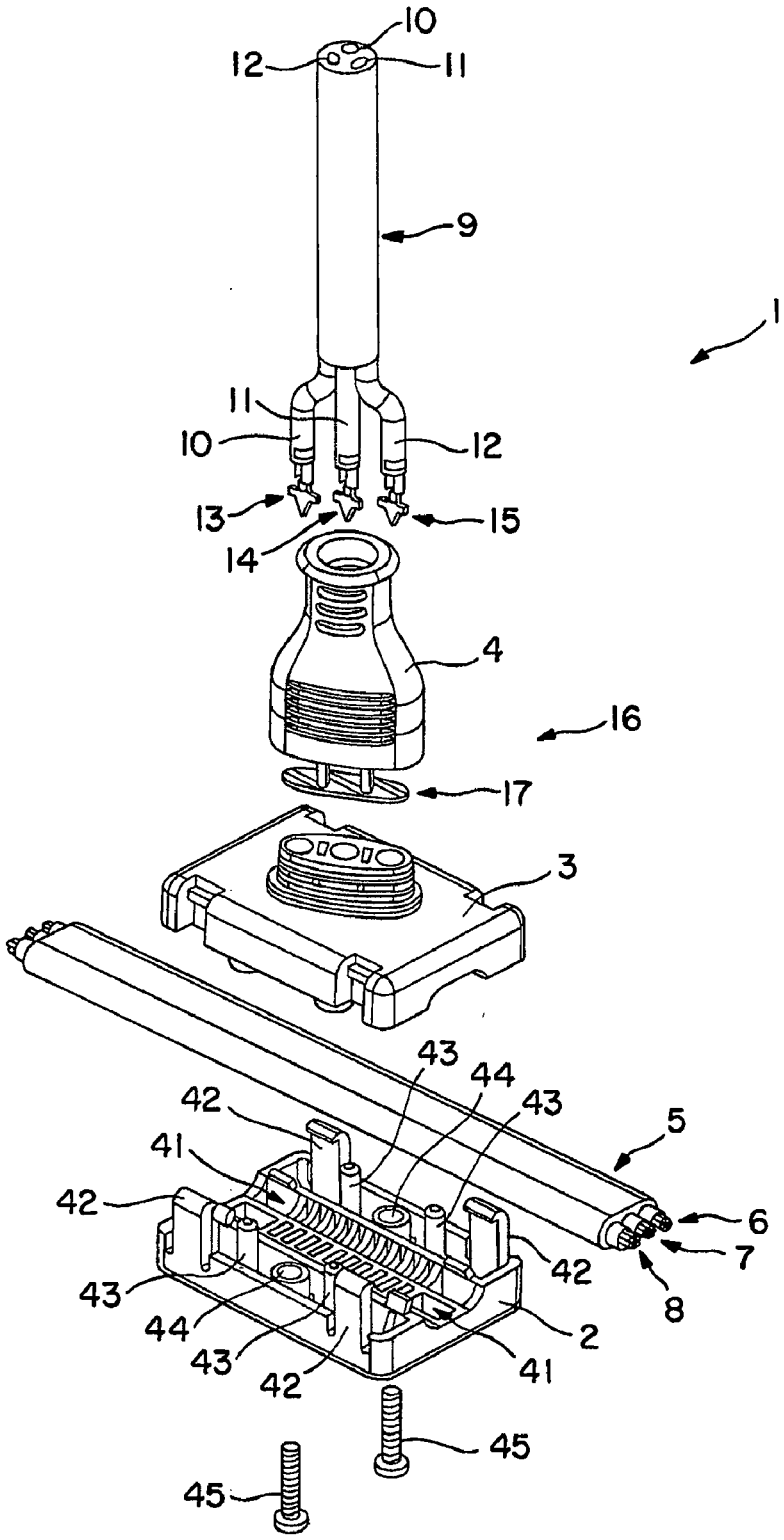
FIG. 6 shows an exploded view of the connecting arrangement of FIG. 1.

FIG. 6 shows the connecting arrangement 1 in an exploded view. According to its arrangement in the integral unit 16, the conductors 10, 11, 12 of the second cable 9 are shown isolated and spread apart.

The first housing 2, like the second housing 3, also has a large number of ribbings 41 which are designed to confirm to the outer contour of the first cable 5 and are used to stabilize the first housing 2. In addition, the first housing 2 comprises tabs 42 designed to correspond with the tab grooves 32, guide pins 43 designed to correspond to the guide holes 30, and screw holes 44 corresponding to the screw recesses 31. Screws 45 can be introduced through the screw holes 44 and can be screwed into the screw recesses 31.

The piercing elements 13, 14, 15 are arranged diagonally, and substantially in series, with respect to a direction perpendicular to the conductors 6, 7, 8 of the first cable 5.

In a modified embodiment of the invention the piercing elements 13, 14, 15 can be arranged substantially transversely also in a row, with respect to the conductors 6, 7, 8 of the first cable 5.

The production method according to the invention of the connecting arrangement will be described hereinafter.

The conductors 10, 11, 12 of the second cable 9 are isolated and bared. The piercing elements 13, 14, 15 are then arranged in electrical connection on the conductors 10, 11, 12. This can be done, for example, by crimping or soldering. The second housing 3 is formed on the second cable 9, connected to the piercing elements 13, 14, 15 to correspond to the shape of the second cable 9 and/or the piercing elements 13, 14, 15. The cable receiver 4 is formed onto the second housing 3. The cable receiver 4 is constructed to correspond to the shapes of the second housing 3 and of the second cable 9 and optionally of the piercing elements 13, 14, 15. The cable receiver 4 is preferably formed onto the second cable 9 and the piercing elements 13, 14, 15 molding. However, other methods are also possible, for example sintering. The second housing 3 and the cable receiver 4 are formed into the integral unit 16 by being formed on one another.

During construction of the second housing 3 the connecting cavities 46, 47 and the sealing recess 48 are also formed.

The toothed profile portion 20 of the second housing 3 is molded during forming of the cable receiver 4 and the sealing element 17. The connecting cavities 46, 47 of the second housing 3 and the sealing recess 48 are also filled, whereby the connecting portions 18, 19 and some of the bearing portion 27 of the sealing element 17 are formed. The contour of the sealing element 17 at the inner side 28 is determined by a mold, whereby the sealing lip 37 is also provided. The contour of the sealing element 17 annularly surrounding the piercing points 23, 24, 25 is also produced.

In another embodiment of the invention the sealing element 17 can also be constructed separately to and/or from the cable receiver 4 on the second housing 3. The sealing element 17 can also be produced as part of the integral unit 16.

Thermoplastic polymer is preferably used to produce the second housing 3 and thermoplastic elastomer to produce the cable receiver 4 and the sealing element 17.

The first housing 2 is produced independently of the construction of the integral unit 16, preferably from thermoplastic polymer.

The first cable 5 is positioned in the first housing 2 to produce an electrical connection between the piercing elements 13, 14, 15 and the conductors 6, 7, 8 of the first cable 5. The integral unit 16 is then assembled on the first housing 2. During joining, the piercing points 23, 24, 25 of the piercing elements 13, 14, 15 protuding from the second housing 3 penetrate transversely into a respective conductor 6, 7, 8 of the first cable 5, so that insulation 49 of the first cable 5 is pierced, (as shown in FIG. 2). Electrical contact is thus produced in each case between the conductors 10, 11, 12 of the second cable 9 and the conductors 6, 7, 8 of the first cable 5.

During joining, the sealing element 17 is also pressed against the first cable 5 by the second housing 3 and, in particular, by the support shoulders 26 of the piercing elements 13, 14, 15. The piercing points 23, 24, 25 are thereby sealed against environmental influences resulting from insertion of the piercing elements 13, 14, 15 in the first cable 5.

During assembly of integral unit 16 and the first housing 2, the guide pins 43 are introduced into the guide holes 30. The integral unit 16 and the first housing 2 are thereby precisely positioned with respect to one another. Consequently, the piercing elements 13, 14, 15 are inserted into the first cable 5 in predetermined positions. The tabs 42 also slide into the corresponding tab grooves 32 and latch in an end position. The screws 45 are introduced through the screw holes 44 into the screw recesses 31 and are tightened.

We claim:

1. A connecting arrangement comprising:

at least a first and a second housing in which at least one conductor of a first cable received in the first housing is electrically connected to at least one conductor of a second cable fed via a cable receiver;

at least one piercing element electrically connected to the at least one conductor of the second cable that is inserted transversely into the conductor of the first cable, the cable receiver is constructed as an integral unit with the second housing and the piercing element;

a sealing element configured to seal a piercing point of the piercing element is arranged on an inner side of the second housing and the cable receiver is disposed on an outer side of the second housing, the sealing element and the cable receiver being formed in one piece through the second housing; and the cable receiver is interlocked with the outer side of the second housing by a plurality of interlocking teeth.

2. The connecting arrangement according to claim 1, wherein the piercing element and the second cable are connected to one another and are at least partially embedded in the integral unit of the second housing and the cable receiver.

3. The connecting arrangement according to claim 2, wherein the integral unit of the second housing and the cable receiver is formed in an interlocking and sealing manner on the second cable and the at least one piercing element.

4. The connecting arrangement according to claim 3, wherein the integral unit is molded onto the second cable.

5. The connecting arrangement according to claim 1, wherein the sealing element comprises a sealing lip oriented toward the inner side of the second housing.

6. The connecting arrangement according to claim 1, wherein the sealing element surrounds the piercing point of the piercing element substantially annularly.

7. The connecting arrangement according to claim 1, wherein the second housing consists of a thermoplastic polymer.

8. The connecting arrangement according to claim 1, wherein the sealing element or cable receiver consists of a thermoplastic elastomer.

9. A method for producing a connecting arrangement with at least a first and a second housing, the method comprising the steps of:

placing a first cable having at least one conductor longitudinally into a first housing;

connecting at least one conductor of a second cable to a piercing element;

connecting the second housing to the second cable with the aid of a cable receiver, the cable receiver and the second housing being formed into an integral unit incorporating the piercing element;

inserting transversely the piercing element into the at least one conductor of the first cable to electrically connect the first and the second cables to one another; and constructing a sealing element with which the piercing point of the piercing element can be sealed on an inner side of the second housing and the cable receiver on an outer side of the second housing, the sealing element and the cable receiver being constructed in one piece through the second housing, and the cable receiver being interlocked with the outer side of the second housing by a plurality of interlocking teeth.

10. The connecting arrangement according to claim 1, wherein the cable receiver at least partially covers the outer side of the second housing.

11. The connecting arrangement according to claim 1, wherein connecting portions extend through connecting cavities in the second housing from the inner side to the outer side of the second housing and integrally connect the sealing element on the inner side of the second housing to the cable receiver on the outer side of the second housing.

12. The method according to claim 9, wherein the cable receiver at least partially covers the outer side of the second housing.

13. The method according to claim 9, wherein connecting portions extend through connecting cavities in the second housing from the inner side to the outer side of the second housing and integrally connect the sealing element on the inner side of the second housing to the cable receiver on the outer side of the second housing.

* * * * *